United States Patent [19]

Yamada et al.

[11] 3,995,368

[45] Dec. 7, 1976

[54] ELECTRIC DRY SHAVER WITH TRIMMER

[75] Inventors: Norio Yamada; Yoshiro Kawano, both of Hikone, Japan

[73] Assignee: Matsushita Electric Works, Ltd., Japan

[22] Filed: June 13, 1975

[21] Appl. No.: 586,757

[30] Foreign Application Priority Data

June 15, 1974 Japan ..... 49-68538

[52] U.S. Cl. ..... 30/34.1

[51] Int. Cl.[2] ..... B26B 19/10

[58] Field of Search ..... 30/34.1, 43.91, 43.92, 30/42, 90

[56] References Cited

UNITED STATES PATENTS

| | | | |
|---|---|---|---|
| 3,376,636 | 4/1968 | Schuessler | 30/34.1 |
| 3,412,463 | 11/1968 | Rundzaitis | 30/43.92 X |
| 3,644,990 | 2/1972 | Crookes | 30/34.1 |

FOREIGN PATENTS OR APPLICATIONS

| | | | |
|---|---|---|---|
| 1,943,425 | 4/1971 | Germany | 30/34.1 |

*Primary Examiner*—Gary L. Smith

*Attorney, Agent, or Firm*—Leydig, Voit, Osann, Mayer & Holt

[57] ABSTRACT

An electric dry shaver of reciprocally vibrated type having long hair trimmer which is driven only when a coupling member mounted to drive means is coupled to clipper cutter of the trimmer by trimmer operating handle manually operated. The clipper cutter has a joint member and the coupling member is normally biased away from engagement with the joint member. The handle as operated into trimmer operating position engages the coupling member to urge it into engagement with the joint member so that the clipper cutter will be coupled to the drive means.

6 Claims, 6 Drawing Figures

ELECTRIC DRY SHAVER WITH TRIMMER

This invention relates to reciprocally vibrated type electric dry shavers and, more particularly, to an electric dry shaver having a trimmer which can be driven only when the trimmer is to be used with an operation of a handle to shift a coupling member for coupling the trimmer to a drive mechanism.

There have been already suggested various types of the dry shavers of this kind. For example, in U.S. Pat. No. 3,644,990, there is shown a type wherein a coupling member is pivotally mounted to an end edge of a trimmer blade. However, in such type, there are defects that a sleeve section for pivotally supporting the coupling member must be formed at an end edge of the trimmer blade and that generally, in manufacturing the trimmer blades, it is difficult to simultaneously provide shearing teeth to many material thin plates placed as overlapped and to carry out a so-called co-rubbing operation by overlapping on one another a comb blade and clipper cutter blade forming the trimmer blades so that the trimmer blade manufacturing operation can not be carried out efficiently. Further, in U.S. Pat. No. 3,690,000, there is shown a type wherein the coupling member is pivotally mounted to a drive end of the driving mechanism. In this device, however, even when the trimmer is not to be used and thus a main shaving blade only is used, the coupling member which is always in sliding engagement with a trimmer operating handle is caused to perform reciprocating motion so that the engaging part between the member and the handle will be always subjected to a wear and the device has to accompany such deterioration all the time.

According to the present invention, an electric dry shaver with a trimmer which is successfully improved in respect of the above described defects is provided, by mounting a coupling member pivotably to a driving member which is laterally vibrated by a vibrator means of a driving mechanism for driving a main shaving cutter so as to give the lateral vibration also to the coupling member itself so that, when the coupling member is brought into an engagement with a cutter blade of the trimmer with an operation of a handle disposed on the shaver body, the trimmer cutter blade will be driven as vibrated in lateral directions.

A primary object of the present invention is, therefore, to provide an electric dry shaver with a trimmer including a clipper cutter blade which is provided only with a joint element and is thus very simple in the form.

Another object of the present invention is to provide an electric dry shaver of the kind referred to wherein a vibration transmitting engagement and disengagement are performed by a shift of a coupling member between a free-fitting opening part and an engaging concave part of the joint element of the clipper cutter blade, whereby ON and OFF operations of the trimmer can be very smoothly performed and the entire shaver structure is simplified.

Other objects and advantages of the present invention shall be made clear upon reading the following disclosures referred to in detail with reference to a preferred embodiment of the invention shown in accompanying drawings, in which.

Figure 1:
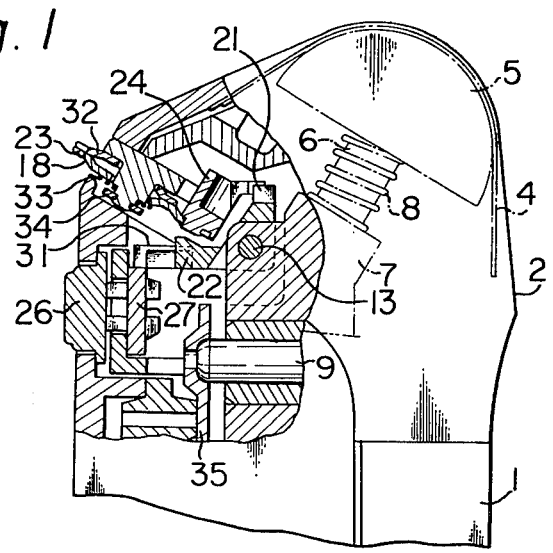
FIG. 1 is a fragmentary sectioned view of an electric dry shaver of the present invention showing a state in which the trimmer is not being driven.

Referring to FIGS. 1 to 4, a frame 2 is provided in the head part of an electric dry shaver body 1, an aperture 3 is provided in the head part of said frame 2 and a beard hair shearing outer blade 4 is fitted to said aperture 3. An inner cutter 5 is disposed inside said shearing outer blade 4 so as to be in contact with it as connected to a driving member 7 of driving mechanism through a connecting rod 6, and the cutter 5 is resiliently pressed against the outer blade 4 by a spring 8 fitted about the rod. The driving member 7 is so formed as to make a reciprocating motion laterally or, in other words, in the direction vertical to beard hairs by a driving mechanism (not illustrated) which comprises a motor or electromagnetic vibrating mechanism provided within the shaver body 1. The driving member 7 rotates about a shaft 9 as a center.

Figure 3:
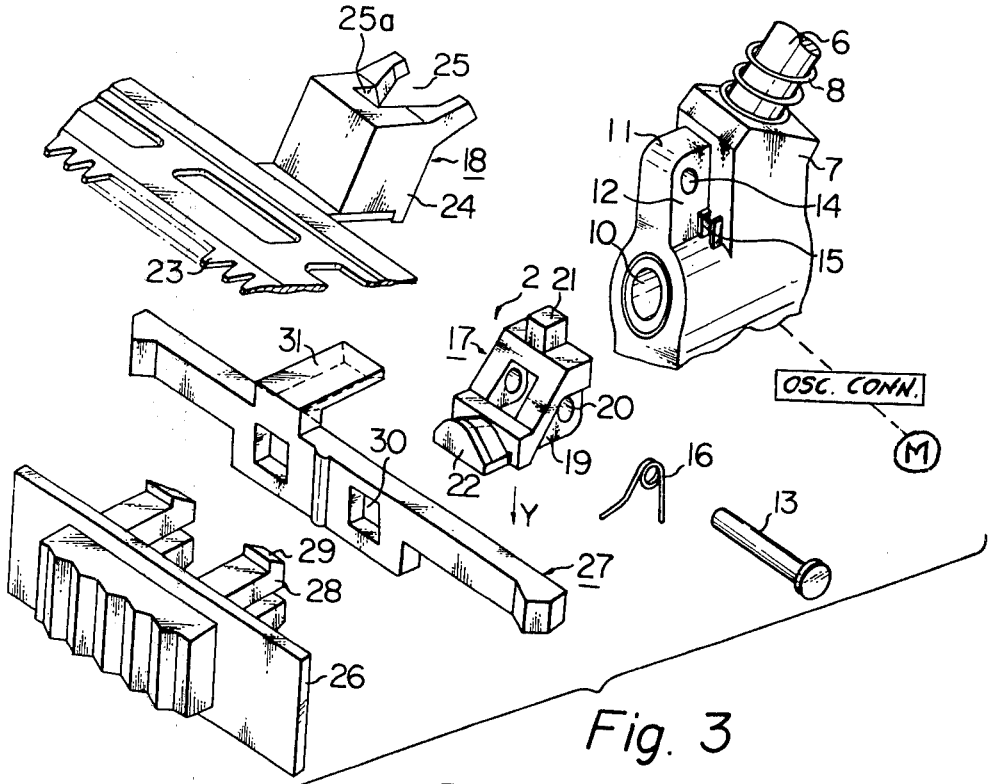
FIG. 3 is a disassembled view as magnified of driving and operating mechanisms for the trimmer in the shaver of FIG. 1.

The trimmer blade driving mechanism shall be detailed in the following. In FIG. 3, the connecting rod 6 is fixed to the head part of the driving member 7, a hole 10 is made substantially in the center of the shaver body and the shaft 9 is fitted in this hold 10. A projection 11 is provided on one side surface of the driving member 7 and formed to be parallel on its both side walls 12 with the axis of the hole 10. A hole 14 for inserting a pin 13 is made in said projection 11. A recess 15 is provided adjacent the hole 14, for receiving an end of a spring 16. 17 is a coupling member, preferably made of a proper synthetic resin, for transmitting vibratory motion of the driving member 7 to a movable clipper cutter 18 of the trimmer. Extended wall parts 19 are provided on both sides of the coupling member 17, which are to be loosely fitted to the projection 11 of the driving member 7 and are provided with holes 20 for inserting a pin 13 therethrough. A projection 21 to be coupled to the cutter 18 is provided in the head part of the coupling member 17 and a stirrup-shaped engaging part 22 is provided on the front surface of the coupling member 17.

Connecting state of the coupling member 17 to the driving member 7 is as follows. The coupling member 17 is loosely fitted to the projection 11 of the driving member 7, the spring 16 is fitted about the pin 13 so as to extend both ends radially from the pin, then the pin 13 is inserted into the holes 20 and 14 in alignment with each other, and an extended end of the spring 16 is engaged in the recess 15 of the driving member 7 while the other end is engaged to the coupling member 17. With such formation, the coupling member 17 is supported in position rotatably about the pin 13 and as normally urged on the back surface against the driving member 7 by the spring 16.

The structure of the trimmer shall be described next. The movable clipper cutter blade 18 of the trimmer is provided in front edge part with shearing teeth 23 and substantially at the center of reverse edge with a joint element 24 preferably made of a synthetic resin. The joint element 24 is provided at the back thereof with a fork-shaped fitting part 25, to which the projection 21 of the coupling member 17 is to be loosely fitted. The fitting part 25 has a narrowed recess part 25*a* of a size allowing the projection 21 to engage therein.

The operating mechanism for the trimmer is as in the following. In the present embodiment shown, the operating mechanism comprises substantially a slidable operating handle 26 to be partly exposed out of the shaver body 1 and a lever 27 to be coupled to the handle as slidably disposed in the body. On the back surface of the operating handle 26, there are provided engaging pawls 28 which having hooked parts 29 at the respective ends. The lever 27 has apertures 30 for inserting the pawls 28 of the handle 26, and the hooked parts 29 prevent the pawls 28 from being pulled out of the apertures. An operating arm 31 directed inward the shaver body is provided on the upper edge and adjacent the center of the lever 27, and downward edge of this arm 31 on the central side is sloped. Thus the lever 27 and handle 26 are so formed that they will be integrally coupled to each other by pushing the pawls 28 of the handle 26 into the apertures 30 in the lever 27. This is for the purpose of convenience of assembly work and, where the assembly allows, the handle and lever may be made as an integral body.

Referring back to FIG. 1, the shaft 9 is supported by a shaft pressing frame 35 so as to provide the driving member 7 with a center axis for its rocking motion.

Figure 2:
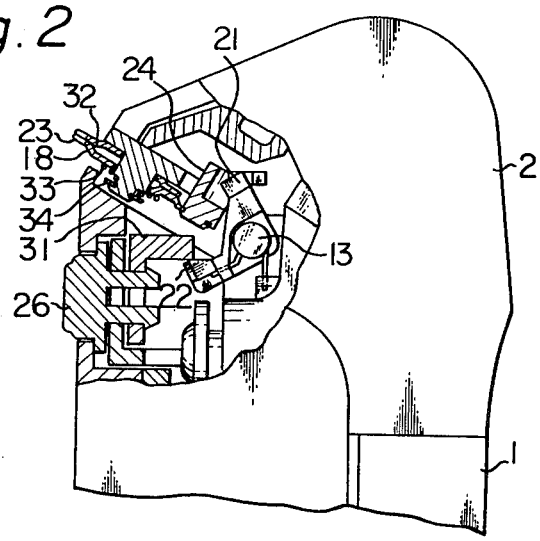
FIG. 2 is a similar fragmentary sectioned view of the shaver of FIG. 1 showing a state in which the trimmer is being driven.

As shown in FIG. 1 or 2, the clipper cutter 18 of the trimmer is resiliently pressed by a spring 33 against the lower surface of a stationary comb blade 32 so as to perform trimming cut of hairs when driven in cooperation with the comb blade 32. The spring 33 is held in position by means of a seat plate 34. Here, the relative positions of the cutter 18 of the trimmer and the coupling member 17 are so regulated that, in case the coupling member 17 is not bound by the operating handle 26, that is, in case the coupling member 17 is kept in close contact with the driving member 7 side by the spring 16, the projection 21 of the coupling member 17 will be positioned near the inlet of the fitting part 25 of the cutter 18 and that, in case the coupling member 17 is bound by the operating handle 26, that is, in case the coupling member 17 is pushed down as will be detailed later against the returning force of the spring 16, the projection 21 of the coupling member 17 will be positioned in the narrowed recess part 25*a* of the fitting part 25 in the joint element 24 of the cutter 18.

The operation of the electric dry shaver with the trimmer of the present invention shall be explained in the following.

When, in the state shown in FIG. 1, an electric switch (not illustrated) is made ON, an electric motor (not illustrated) will rotate, which rotation is transmitted to the driving member 7 and the member 7 performs a reciprocating vibration with the shaft 9 as the center, then the cutter 5 will vibrate along inner surface of the shearing outer blade 4 so that any beard hairs led into shaving holes of the blade 4 will be cut by the cutter 5 and thus the normal beard hair shaving is performed. In this state, the coupling member 17 mounted to the driving member 7 also vibrates together with the member 7 but its projection 21 is not engaged in the fitting part 25 of the trimmer cutter 18, so that the trimmer will not be driven.

Figure 4:
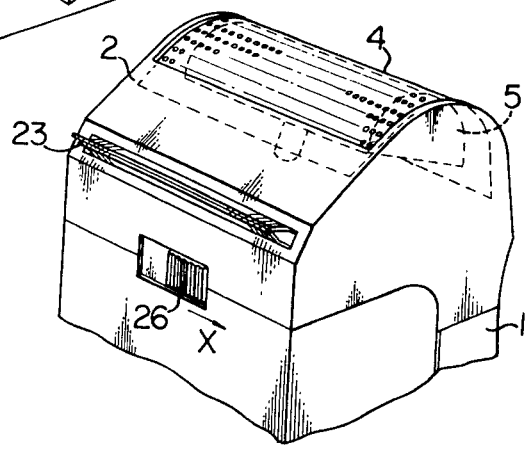
FIG. 4 is a perspective view showing external appearance of only shaving head part of the shaver of FIG. 1.

When the handle 26 is laterally moved manually in the direction indicated by an arrow X in FIG. 4, the lever 27 will slide together with the handle, the sloped edge of the operating arm 31 of the lever 27 will come into abutment against the stirrup-shaped engaging part 22 of the coupling member 17 so as to push down the same in the direction indicated by an arrow Y in FIG. 3, and the coupling member 17 will rotate in the same direction with the pin 13 as an axis, so that the projection 21 at the top of the coupling member 17 will enter the fitting part 25 of the joint element 24 in the cutter 18 so as to fit therein, whereby the vibration from the driving member 7 will be transmitted to the trimmer cutter 18 and the cutter will operate. This state in which the trimmer is coupled to the driving member 7 through the coupling member 17 is shown in FIG. 2.

Figure 5:
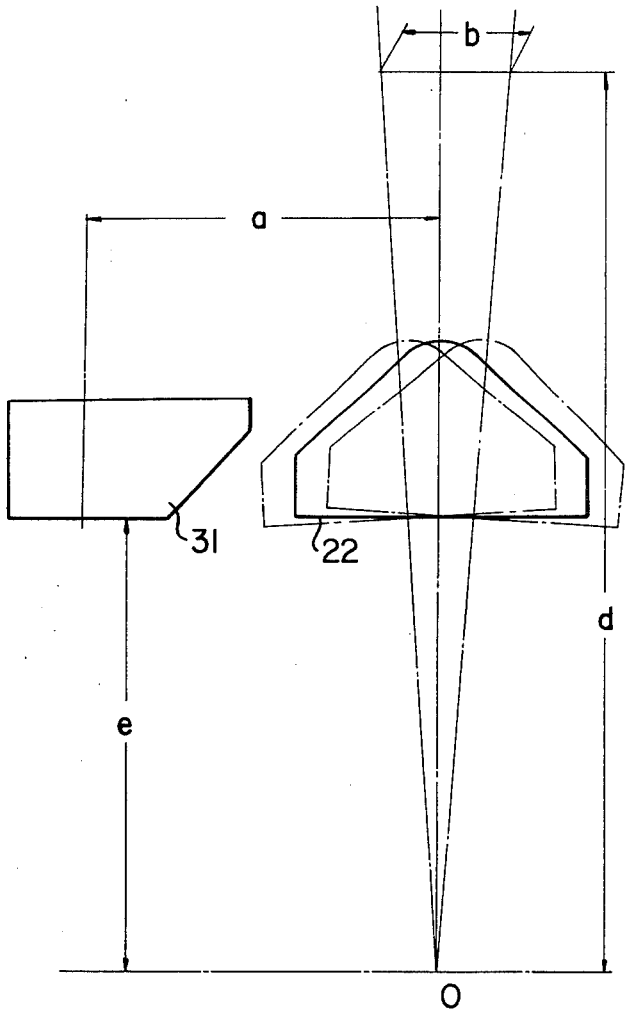
FIGS. 5 and 6 are diagrams showing operational relations between an operating arm part of a trimmer operating lever and an engaging part with said lever of a coupling member in the shaver of FIG. 1 at the time of non-operation and operation, respectively.
Figure 6:
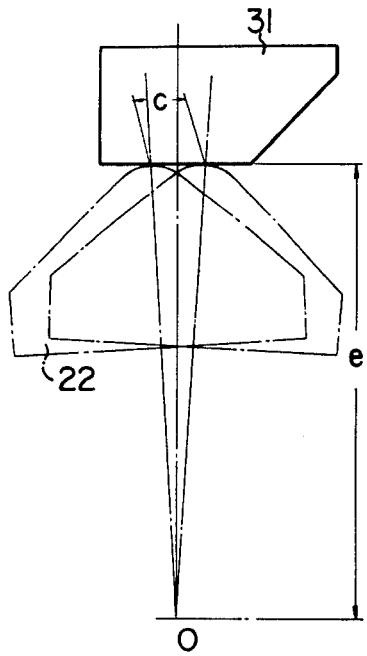

FIGS. 5 and 6 show relations of the operating arm 31 of the operating lever 27 and the engaging part 22 of the coupling member 17 at the time of the trimmer's non-operation and operation, respectively. Symbol *a* represents the distance between the operating arm 31 of the operating lever 27 and the lever engaging part 22 of the coupling member 17, *b* represents the amplitude of the tip of the lever engaging part 22, *c* represents (see FIG. 6) the distance through which the uppermost tip of the lever engaging part 22 reciprocally slides while being in contact with the lower surface of the operating arm 31, *d* represents the distance from the rotation center 0 of the driving member 7 to the tip of the projection 21 of the coupling member 17, and *e* represents the distance from the rotation center 0 to the operating arm 31 when the same is positioned above the engaging part 22. The respective distances *b*, *c*, *d* and *e* are in the relation of $e/d = c/b < ½$. In this embodiment, as the distance $b \fallingdotseq 2$mm, the distance $c <$ 1mm. This distance $c <$ 1mm is so smaller than sliding distance of th trimmer's clipper cutter 18 and reciprocating amplitude of the main shaving cutter 5 that the influence of the friction between the operating arm 31 and the lever engaging part 22 can be substantially negligibly reduced if materials of the respective parts are properly selected and the spring 16 is properly regulated in its resiliency.

What is claimed is:

1. An electric dry shaver comprising a main shaving blade assembly of an outer shearing blade provided in a frame of shaver body and an inner cutter blade provided slidably in contact with inner surface of said outer shearing blade, a trimmer blade assembly of a comb blade fixed to the shaver body and a clipper cutter blade slidable along said comb blade, a driving means for providing a reciprocating motion to said cutter blade of main shaving blade assembly, a coupling means rotatably pivoted to said driving means for moving always together with the driving means, and a handle fitted to the shaver body so as to be movable between engaging and disengaging positons with said coupling means, said coupling means being rotated to engage with said clipper cutter blade of the trimmer blade assembly only when said handle is moved into said engaging position with the coupling means so that the coupling means will transmit the reciprocating motion of the driving means to the clipper cutter blade.

2. An electric dry shaver according to claim 1 wherein said driving means is vibrated about a shaft fixed to the shaver body and is provided on its side facing said clipper cutter blade with a projection, and said coupling means is pivoted to said projection of the driving means and is provided at the head part with a projection and at the lower part with an engaging part with said handle.

3. An electric dry shaver according to claim 1 wherein said clipper cutter blade of the trimmer blade assembly is provided with a joint member at reverse side of shearing teeth of the blade, said joint member has a fitting part to which said coupling means fits when said handle is positioned in said engaging position with the coupling means.

4. An electric dry shaver according to claim 1 wherein said coupling means is provided with a projection on its side facing said handle, and said handle has a lever integrally coupled to the handle on its side facing the coupling means, said lever being provided with an operating arm which is engageable with said projection of the coupling means when the handle is in said engaging position with the coupling means.

5. An electric dry shaver according to claim 4 wherein said projection of the coupling means is formed in a stirrup shape.

6. An electric dry shaver comprising a shaver body including a motor, a main shaving assembly formed of an outer shearing blade secured to the shaver body and an inner cutter blade, an oscillating drive member having its input coupled to the motor and its output coupled to the cutter blade for reciprocating the same, a trimmer blade assembly including a comb blade secured to the shaver body substantially at right angles to the oscillation axis and a clipper blade slidable therealong, means for selectively coupling together the drive member and the clipper blade, the coupling means having a first part and a second part with respective interengageable surfaces, one of the parts being mounted on the drive member for bodily oscillation therewith and the other part being connected to the trimmer blade, the first part being in the form of a rockable member rockable about an axis substantially at right angles to the oscillation axis between (a) a retracted position in which the surfaces are out of engagement and (b) a projecting position in which the surfaces are in engagement accompanied by reciprocation of the trimmer blade, a cam follower surface on the rockable member, a cam mounted on the body and manually shiftable between a "trimmer off" position in which the rockable member is in its retracted position and a "trimmer on" position in which the cam engages the cam follower surface to rock the rockable member into its projecting position for interengagement of the surfaces for reciprocation of the trimmer by the drive member.

* * * * *